US009358175B2

(12) United States Patent
Bordan

(10) Patent No.: US 9,358,175 B2
(45) Date of Patent: Jun. 7, 2016

(54) ASSISTIVE WALKING DEVICE WITH ADJUSTABLE DIMENSIONS

(71) Applicant: Douglas Bordan, New York, NY (US)

(72) Inventor: Douglas Bordan, New York, NY (US)

( * ) Notice: Subject to any disclaimer, the term of this patent is extended or adjusted under 35 U.S.C. 154(b) by 0 days.

(21) Appl. No.: 14/272,749

(22) Filed: May 8, 2014

(65) Prior Publication Data

US 2015/0320631 A1 Nov. 12, 2015

(51) Int. Cl.
*A61H 3/00* (2006.01)

(52) U.S. Cl.
CPC ..... *A61H 3/00* (2013.01); *A61H 2003/001* (2013.01)

(58) Field of Classification Search
CPC ..... A61H 3/00; A61H 3/04; A61H 2003/001
USPC ..... 135/67
See application file for complete search history.

(56) References Cited

U.S. PATENT DOCUMENTS

| | | | | | |
|---|---|---|---|---|---|
| 480,910 | A | | 8/1892 | Tong | |
| 2,556,121 | A | * | 6/1951 | Thomas | A61G 5/10 280/304.1 |
| 3,455,313 | A | * | 7/1969 | King | 135/67 |
| 4,094,330 | A | | 6/1978 | Jong | |
| 4,777,973 | A | * | 10/1988 | Nakajima | 135/67 |
| 4,995,412 | A | * | 2/1991 | Hirn et al. | 135/67 |
| 5,529,425 | A | | 6/1996 | Spies et al. | |
| 5,649,558 | A | * | 7/1997 | Richard | 135/67 |
| 5,853,015 | A | * | 12/1998 | Evans | 135/67 |
| 6,145,524 | A | * | 11/2000 | Li et al. | 135/67 |
| 6,453,921 | B1 | * | 9/2002 | Rost | 135/67 |
| 7,278,436 | B2 | | 10/2007 | Gale et al. | |
| 7,373,942 | B1 | | 5/2008 | Yeager | |
| 7,497,226 | B2 | | 3/2009 | Li et al. | |
| 2011/0226296 | A1 | * | 9/2011 | Huggins | 135/66 |
| 2011/0232665 | A1 | * | 9/2011 | Barnett, Jr. | 132/200 |
| 2012/0298160 | A1 | * | 11/2012 | Hamilton | 135/66 |
| 2013/0061892 | A1 | * | 3/2013 | Huang | 135/67 |

* cited by examiner

*Primary Examiner* — David R Dunn
*Assistant Examiner* — Danielle Jackson
(74) *Attorney, Agent, or Firm* — Myron Greenspan; Lackenbach Siegel LLP

(57) ABSTRACT

An adjustable walker includes a tubular frame construction having front and lateral telescoping tubes defining a walker space for a user. The lateral tubes have handgrips suitable for being grasped by a user. The front telescoping tubes are adjustable in length to adjust the width of the walker space for the user and the lateral telescoping tubes are adjustable in length to adjust the height of the handgrips. Locking mechanisms are provided for locking the front telescoping tubes and the lateral telescoping tubes. Actuators on the handgrips selectively unlock the locking mechanisms to allow a user to adjust the width of the walker space and for selectively unlocking the second locking to allow a user to adjust the height of said handgrips to adjust the height and/or width of the walker by use of said actuators on said handgrips without bending or letting go of the walker.

14 Claims, 14 Drawing Sheets

ASSISTIVE WALKING DEVICE WITH ADJUSTABLE DIMENSIONS

BACKGROUND OF THE INVENTION

1. Field of the Invention

The present invention relates generally to an assistive walker with adjustable dimensions. More specifically, this invention will allow users to adjust the height and width of the walker from the top of the walker. The invention will also allow for removable attachments.

2. Description of the Prior Art

Walkers are devices that can be used by adults to help assist them whenever they need to walk somewhere. Walkers can be used by a wide variety of people for various reasons. They may be used by the elderly and/or obese if they have difficulty supporting themselves. They may also be used by amputees. They are even used by people who are going through rehabilitation for various injuries. Because of their vase cliental base, walkers can come in many different variations. Some of these variations include zero, two, and four wheeled walkers. There are also walkers with adjustable dimensions and various attachments.

Walkers are often utilized in nursing homes and/or hospitals where they may be used by multiple people in a single day. Because of this, the more robust a walker is the more valuable and useful it can become. Robustness can include walkers that have attachments which can be swapped in and out as well as walkers that can be adjusted to different dimensional requirements. It is also important that walkers be robust enough to support heavy weighs. There are many walkers that address these issues; however it is done in a way such that a new problem may arise. Most walkers with adjustable dimensions are able to transform by using a pin and lock system to lock the walker into place certain pre-described distance points. While this does solve the initial problem, it also creates another one. Anytime adjustments need to be made a user must disengage with the walker to make the adjustments, usually near the bottom of the walker.

Examples of such constructions are disclosed in U.S. Pat. No. 7,278,436; U.S. Pat. No. 4,094,330; U.S. Pat. No. 7,373,942 and U.S. Pat. No. 4,80,910; U.S. Pat. No. 7,497,226; U.S. Pat. No. 5,529,425.

In many cases the user is relying on the walker as their means of support. Whenever this is the case a helper must do the adjustments for the user. This usually results in the user having to be sat down or supported by something else. It would be much more preferable if the adjustments could be made without the user having to disengage from the walker. Therefore it is the object of the present invention to provide a walker that has adjustable dimensions and that allows the user to adjust the dimensions without disengaging from their standard upright position. This invention will also allow for removal wheels and other attachments.

SUMMARY OF THE INVENTION

An adjustable walker comprises a tubular frame construction having front and lateral telescoping tubes defining a walker space for a user therebetween. Said lateral tubes have handgrips suitable for being grasped by a user, said front telescoping tubes being adjustable in length to adjust the width of the walker space for the user and said lateral telescoping tubes being adjustable in length to adjust the height of the handgrips. First locking means are provided for locking said front telescoping tubes and second locking means are provided for locking said lateral telescoping tubes. A first actuator is provided on said handgrips for selectively unlocking said first locking means to allow a user to adjust the width of the walker space. A second actuator is provided on said handgrips for selectively unlocking said second locking means to allow a user to adjust the height of said handgrips. A user can, thereby, adjust the height and/or width of the walker by use of said actuators on said handgrips without bending or letting go of the walker.

BRIEF DESCRIPTION OF THE DRAWINGS

Those skilled in the art will appreciate the improvements and advantages that derive from the present invention upon reading the following detailed description when taken together with the following drawings in which.

DETAILED DESCRIPTIONS OF THE INVENTION

Figure 1:
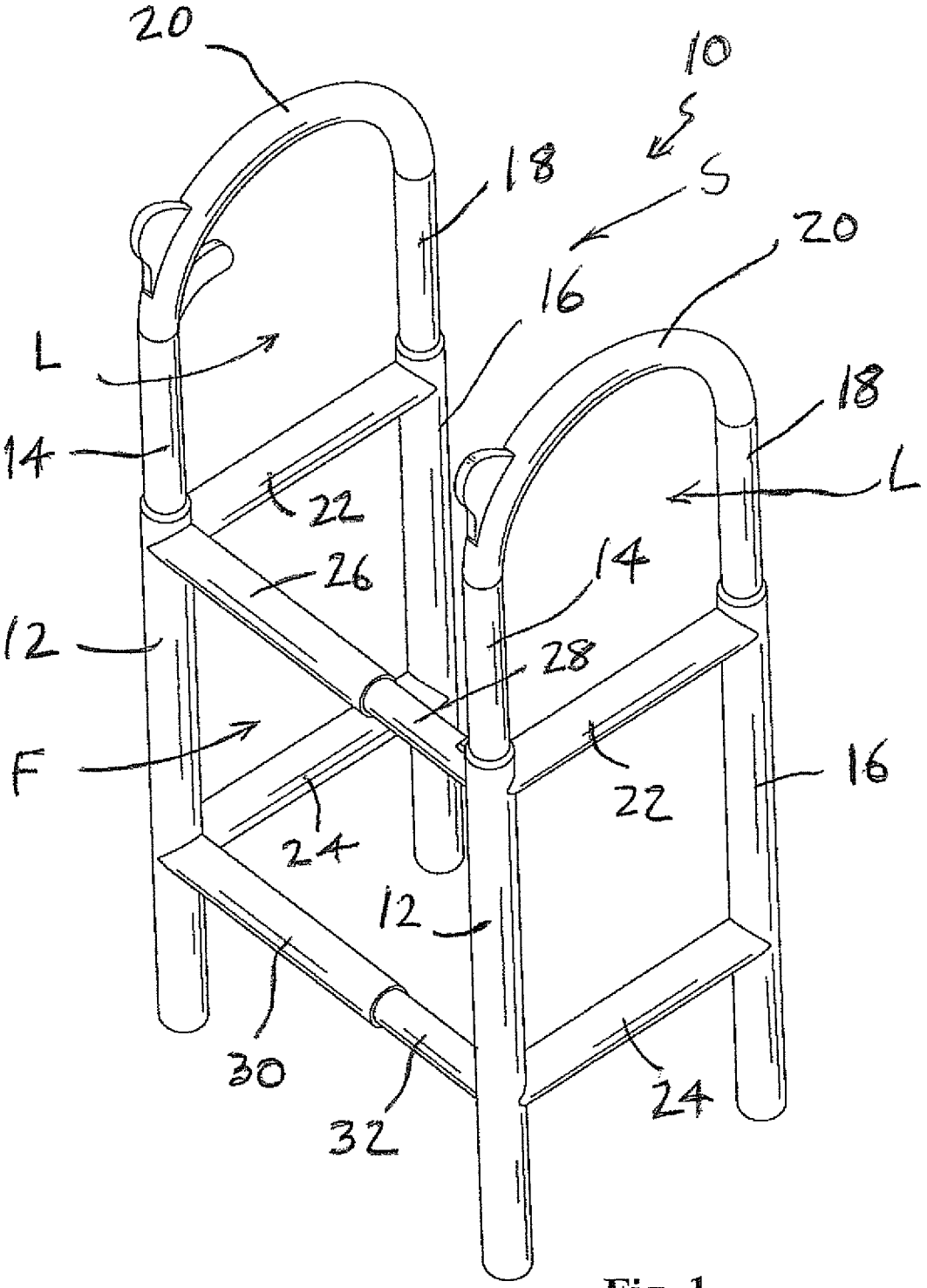
FIG. 1 is a front perspective view of an adjustable walker in accordance with the invention, shown set to predetermined height and width dimensions.
Figure 2:
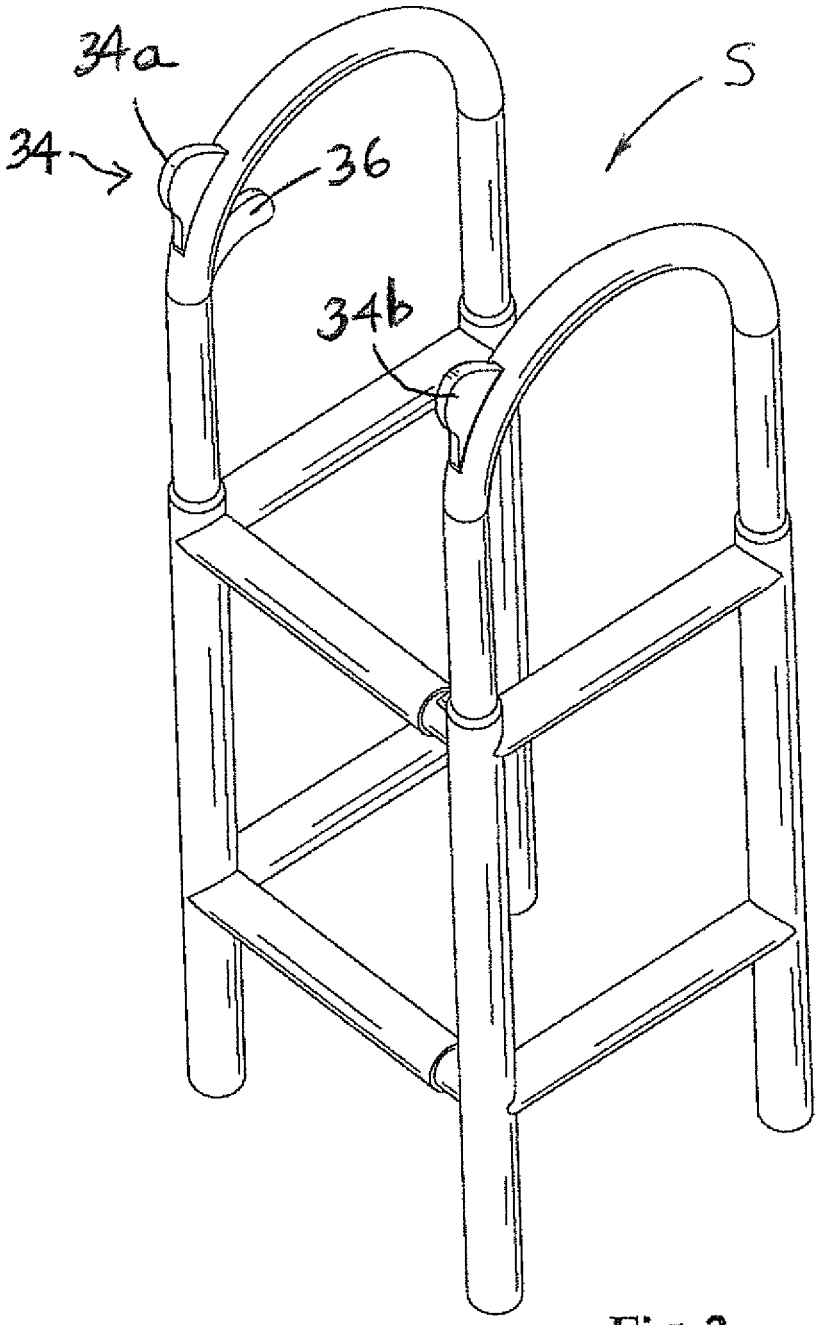
FIG. 2 is similar to FIG. 1 but shows in an adjusted state in which the height of the handgrips has been increased while the width of the walker has been decreased.

All illustrations of the drawings are for the purpose of describing selected versions of the present invention and are not intended to limit the scope of the present invention.

The present invention is a walker that will allow users to adjust the height and width dimensions so that people of different weights, girths, and heights can comfortably use the device. The present invention is also a walker that will allow users to change its dimensions without requiring the user to bend down or fully disengage from the walker itself. The invention has two different adjustments at the top of the walker. The first adjustment will be used to change the height of the walker and the second will be used to adjust the width of the walker. The present invention will also have one bottom adjustment. The bottom part of the walker can have an adjustment that can allow for various attachments, including wheels.

The present invention will, generally, resemble a standard walker. There are support legs, support arms, handles, grips, attachment wheels, actuators and adjustment mechanisms. The support legs are vertically positioned cylindrical shaped columns that are spaced a distance apart in a rectangular shape. The support legs are connected together by the support arms. The support arms are cylindrical shaped pillars that are placed horizontally between all of the legs except for the back two. There are multiple support arms placed between each of the legs. These arms are vertically spaced a distance apart from each. The handles are semi circular shaped objects at the top of the walker. They are connected to the tops of two of the arms, creating the left and right side of the walker. Attached to the handles, near their apex, are the grips. The attachment wheels may or may not be attached to the walker at any point in time. When attached, the wheel attachments will be positioned at the bottom of the walker, on the ends of the support legs. The adjustment mechanisms and the actuators will be placed at various locations in and around the invention.

In the present invention the support legs and the support arms are used to support most of the weight of the user. They also give the walker its shape and structural support. The support legs and support arms may also be used to house some of the adjustment mechanisms and actuators. The handles, located at the top of the walker, are the components that users can grab to support themselves when they are using the invention. The handles may also house some of the adjustment mechanisms and actuators. The grips are ergonomically designed hand cushions that are placed at the top of the handles. The grips are the areas of the invention where users will hold the invention to use it. The attachment wheels are detachable wheels that can be taken off of the invention. This will allow the invention to go from a wheel-less state with increased stability to a wheeled start with increased mobility to a semi-wheeled state that brings a balance of both. The actuators are any devices or series of devices that are used to induce the change in dimension of the invention. This can include, but is not limited to, motors, gear, springs, screws, pistons, and any combination of the aforementioned devices. The adjustment mechanisms are any of the devices that are used to power or activate any of the actuators. This can include, but is not limited to buttons, triggers, and switches.

In one embodiment of the present invention, the dimensional transformation of the walker is achieved through the use of a caulking-gun type mechanism (FIGS. 1-6). In another embodiment (FIGS. 7-14) use is made of gas (pneumatic) springs or hydraulic pistons. For the preferred embodiment, the general positions of the components do not change; however there are slight variations in their construction because of the introduction of sub components. In the preferred embodiments, the support legs are broken into two subcomponents; the lower support legs and the upper support legs. The support arms are also broken into two sub components; the outer support arms and the inner support arms. The lower support legs have two distinct regions; a hollow region and a solid region. The solid region of the support legs constitutes approximately the bottom two-thirds of the support legs. The hollow region starts where the solid region ends and continues up to the top of the lower support leg. The solid and hollow regions have identical diameters, but the hollow region is hollowed out, with an indented top. The indented top is a section of the hollow region that has a smaller diameter than the rest of the region. Inside the hollow region of the lower support leg rests the upper support leg. The upper support leg rests inside the lower support leg. The upper support legs have a diameter equal to that of the indent region of the lower support legs, except at its bottom. The bottom of the upper support legs has an extended base with a wider diameter, equal to that of the inner diameter of the hollow region. The outer support arms are the mostly hollow, exterior region of the support arms. The right most edge of the outer support arms has an indented edge. The indented edge is indented such that its diameter is less that of the diameter of the rest of the outer arm. The inner support arm is also hollow. It has an outer diameter equal to that of the indented edge of the outer support arm; except at its left most edge. At the left edge the inner support arm has an extended edge, with an outer diameter equal to that of the inner diameter of the outer support arm. The handle is also hollow in the preferred embodiment.

In the preferred embodiments, the upper support legs will rest inside of the lower support legs. The upper support legs will be able to slide up and down inside the lower support legs because there is no rigid connection between the two. The upper supports legs are constrained from travelling outside of the lower support legs by the indented top and the extended base. The narrow diameter of the indented top overlaps with the diameter of the extended base and prevents the upper support arms from travelling outside the confines of the lower support arms. When the preferred embodiment is in the rest position the bottom of the extended base is flush with the top of the solid region. When the preferred embodiment is in the extend position the top of the extended base is flush with the bottom of the indented top. The inner support arms will rest inside of the outer support arms. The inner support arms will be able to slide left and right inside the outer support arms because there is no rigid connection between the two. The inner supports arms are constrained from travelling outside of the outer support arms by the indented and extended edges. The narrow diameter of the indented edge overlaps with the diameter of the extended edge, which prevents the upper support arms from travelling outside the confines of the lower support arms. When the preferred embodiment is in the rest position the bottom of the extended edge is flush with the bottom of the outer support arm. When the preferred embodiment is in the extend position the top of the extended edge is flush with the bottom of the indented edge.

A specific example of one presently preferred embodiment will be described in connection with FIGS. 1-6. The walker is generally designated by the reference numeral 10 and consists of a tubular frame construction having a front side "F" and two lateral sides "L" that define a space "S" for a user. The front and lateral sides share front vertical outer tubes 12 and front vertical inner tubes 14 which are arranged to be in telescoping relationship with the tubes 12. The lateral sides also include rear vertical outer tubes 16 and rear vertical inner tubes 18 that are in telescoping relationship with the outer tubes 16. The front and rear inner tubes 14, 18 are connected by upper arcuate handgrips 20 that are affixed to the inner tubes 14 and 18. However, the shape of the handgrips is not critical and other shapes such as square, round, elliptical, etc. can be used.

Lateral upper and lower connecting tubes 22, 24 are affixed to the front and rear vertical outer tubes 12, 16 as shown. The front F of the walker 10 includes an upper front horizontal outer tube 26 telescopically coupled to an upper front horizontal inner tube 28 and, similarly, a lower front horizontal outer tube 30 is telescopically associated with a lower front horizontal inner tube 32. The telescoping tubes both at the lateral sides L of the walker as well as the front F of the walker allow the telescoping tubes to be lenghtened or shortened. The adjustment of the vertical telescoping tubes 12, 14 and 16, 18 raising or lowering the handgrips 20 while adjustment of the telescoping front tubes 26, 28 and 30, 32 allow the walker to be adjusted in width from one lateral side to the other.

An important feature of the present invention is the provision of locking mechanisms that affix the telescoping tubes in place to normally prevent inadvertent or undesired adjustment or telescoping movements in height or width. Selective adjustments can be effected by the actuating members 34, 36 provided on the handgrips to allow convenient and ready access by a user using the walker or by a third party caregiver to adjust the height of the handgrips 20 or the width of the walker to accommodate the size of the patient or user. Towards this end there are provided upper and lower actuating members 34 (34*a*, 34*b*) and 36, respectively. The upper actuating members 34*a*, 34*b* can be used to adjust the height of the handgrips while the lower actuating member 36 can be used to adjust the width of the walker 10.

Figure 3:
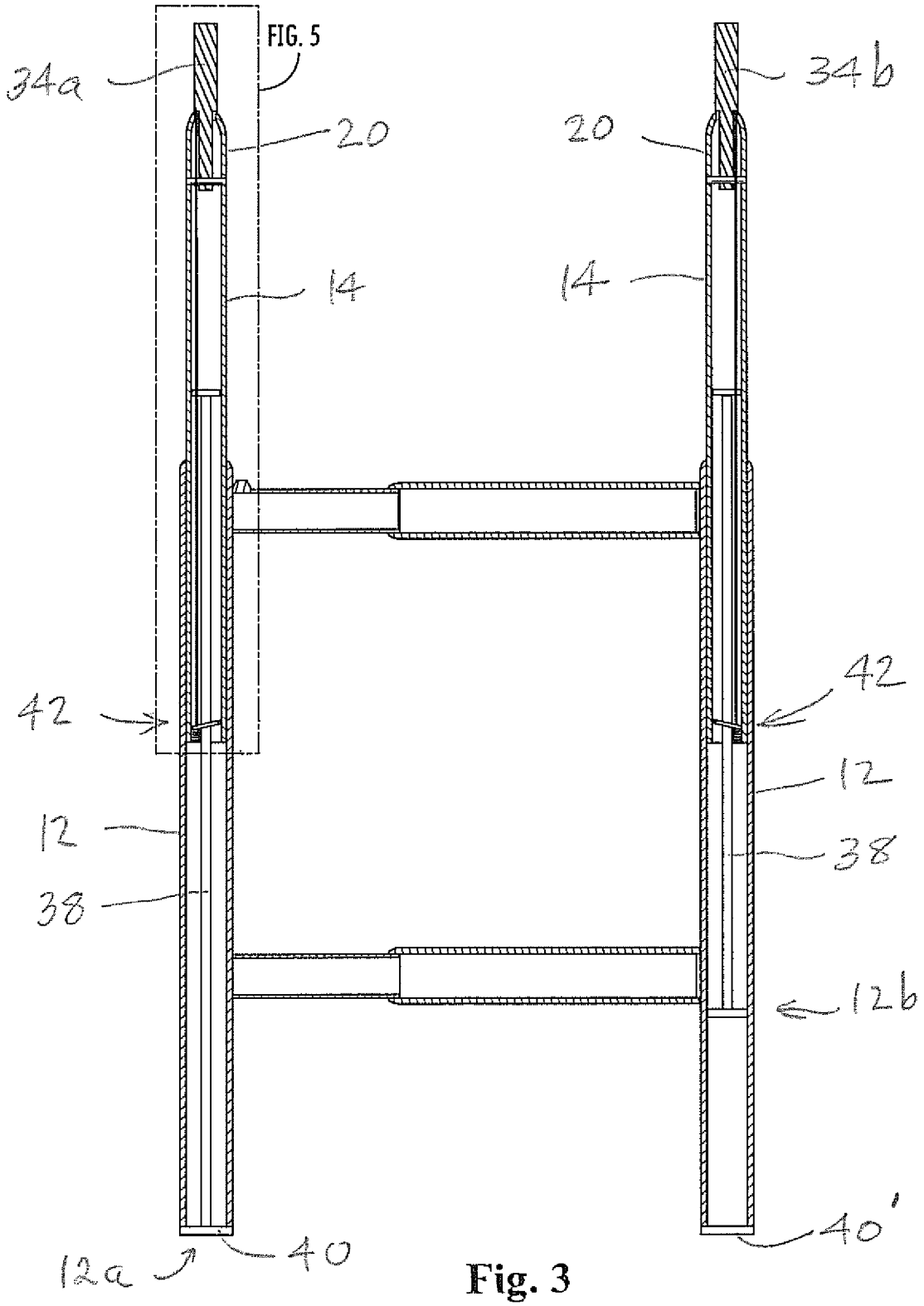
FIG. 3 is a cross sectional view taken through a plane generally coextensive with the front of the walker showing the details of the locking and adjustment mechanism for adjusting the height of the handgrips of the walker.
Figure 4:
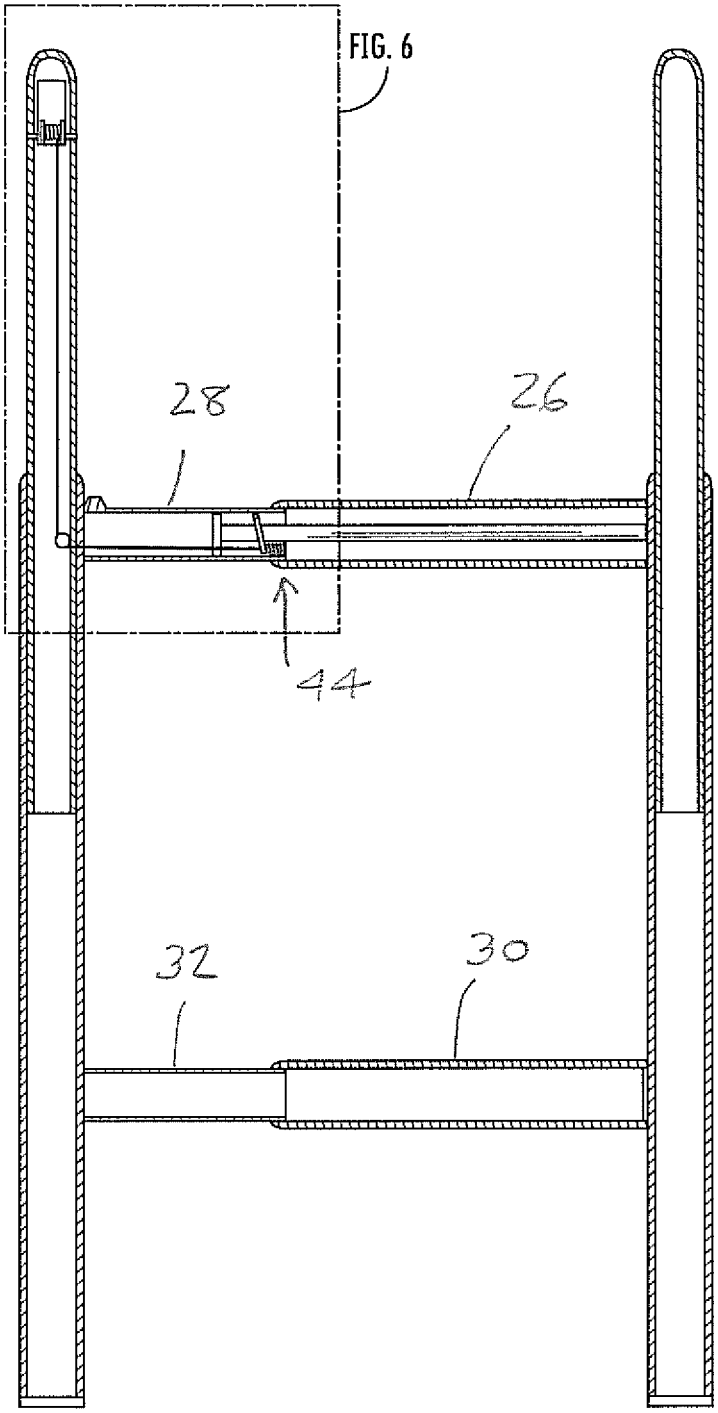
FIG. 4 is similar to FIG. 3 shown with the height of the handgrips increased and the width of the walker decreased to correspond to the view shown in FIG. 2 and showing the details of the locking and adjustment mechanism for adjusting the width of the walker.

Referring the FIGS. 3 and 4, a presently preferred embodiment of the locking and adjustment mechanism is shown in greater detail. Vertical rods 38 are fixed in relation to the outer tubes 12 and extend into the inner tubes 14. The rods may be fixed to the outer tubes at the lower ends 12*a* or at an intermediate point 12*b* (FIG. 3). As suggested in FIG. 3, the rods need not extend all the way to the bottom of the tubes 12 and may be shortened as shown. The rods are preferably stabilized both at the top and the lower ends and any means of stabilization can be used to maintain the rods generally centrally positioned within the tubes or generally extending along the axes of the vertical and horizontal tubes while allowing axial sliding movements along the inner tubes 14. Rod stabilizers 40, 40' shown, by way of example, as one method of affixing and stabilizing one end of the rod. The specific method used is not critical and any suitable method for maintaining the rods in the desired positions can be used.

In FIGS. 3 and 4, locking mechanism 42 is shown for locking the telescoping tubes 12, 14 to each other when downward pressure is applied to the handgrips 20. The locking mechanism 42 is generally in the nature of a well known caulking-gun type mechanism. A width locking mechanism, also a caulking-gun type mechanism 44, is similarly used in conjunction with adjustments and locking of the horizontal tubes 26, 28 relative to each other.

Figure 5A:
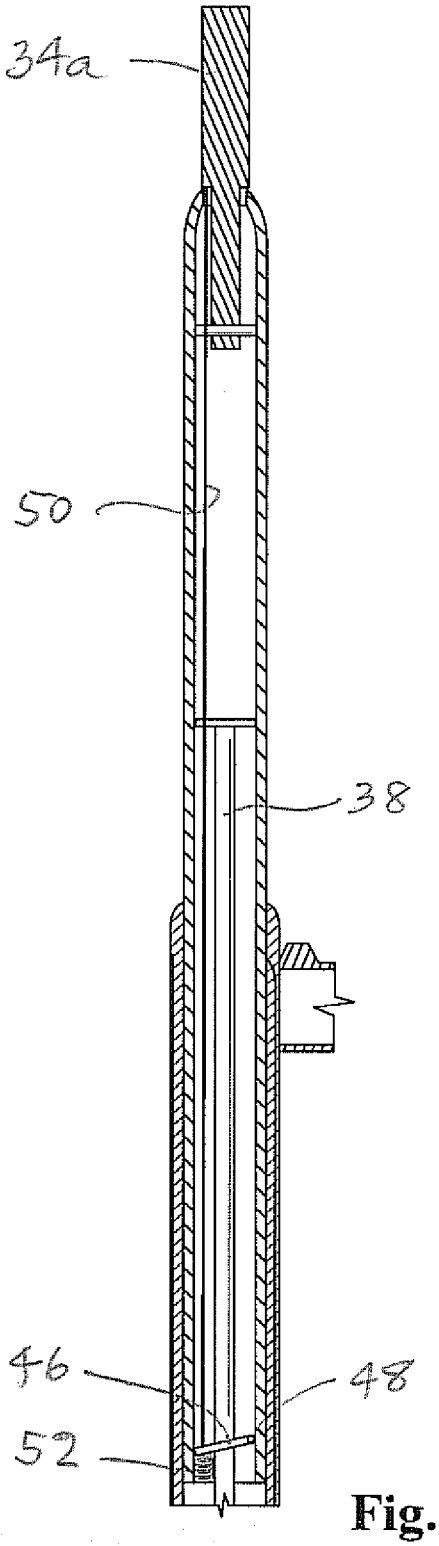
FIG. 5A is an enlarged cross sectional view of the detail labeled "FIG. 5" in FIG. 3 in a locked condition of the handgrips.
Figure 5B:
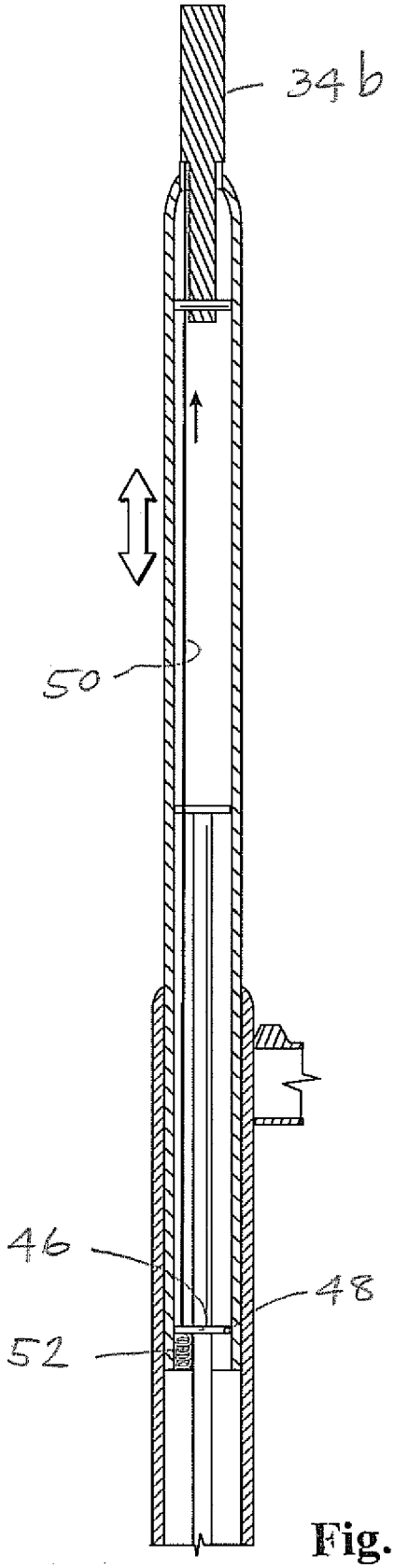
FIG. 5B is similar to FIG. 5A shown in an unlocked condition to allow vertical movements of the raised handgrips.
Figure 6:
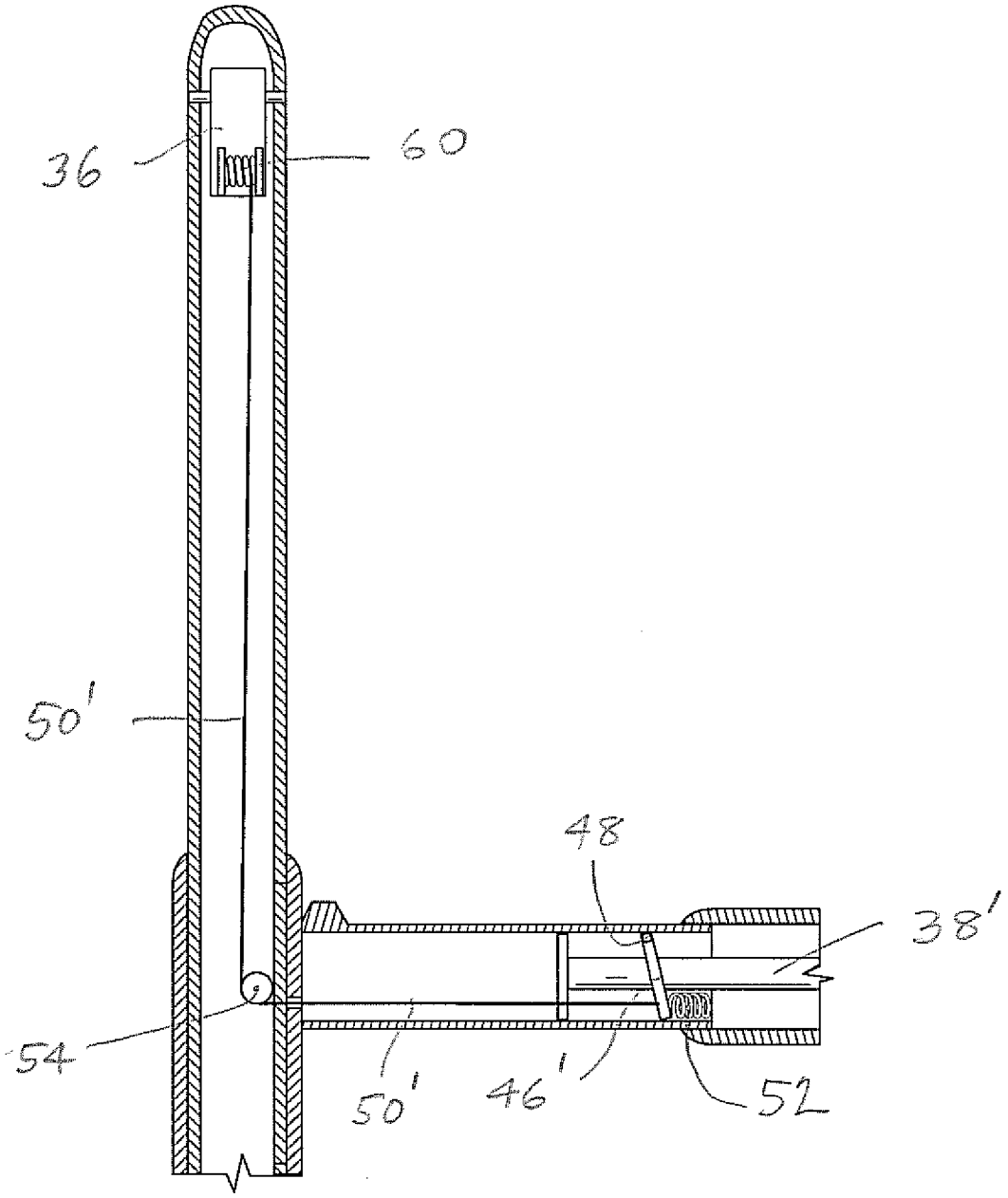
FIG. 6 is an enlarged cross sectional view of the detail labeled "FIG. 6" shown in FIG. 4.
Figure 7:
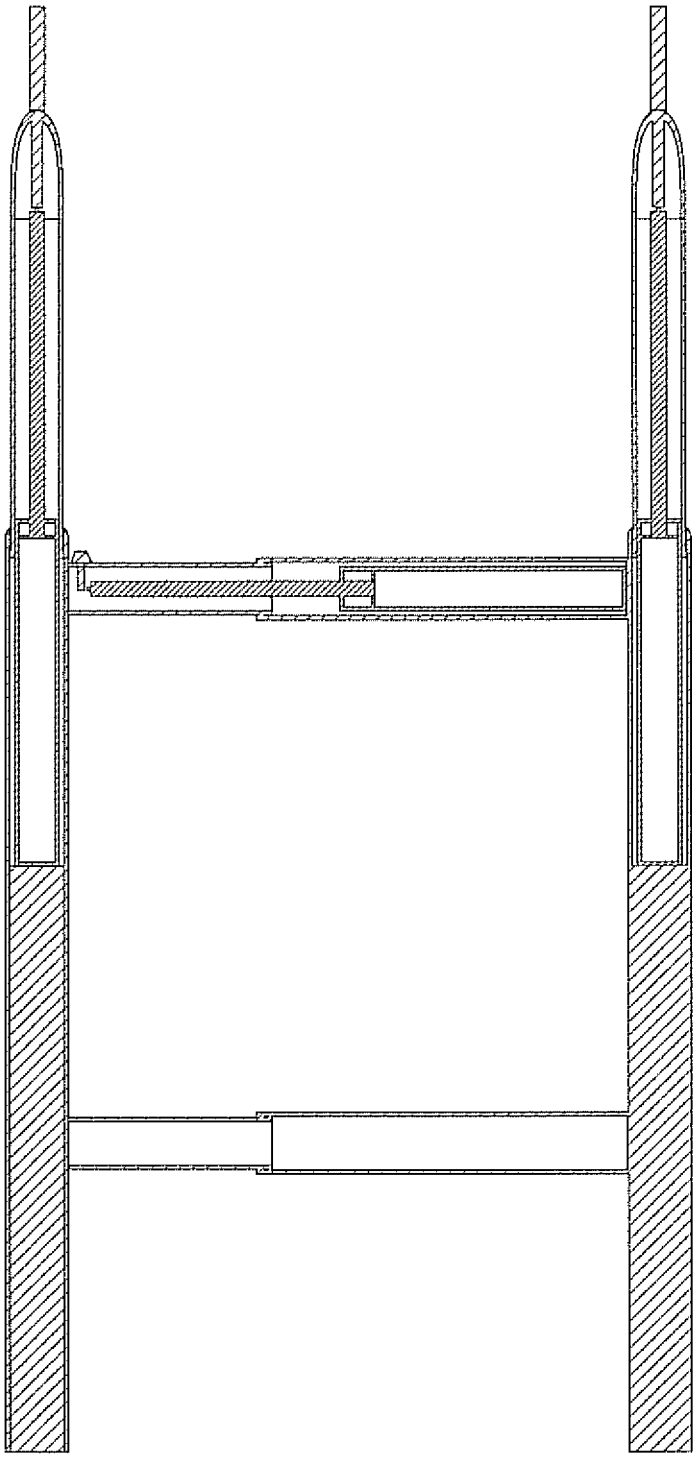
FIGS. 7-14 illustrate another embodiment of the walker but showing a pneumatic or hydraulic adjustment and locking mechanism for adjusting the height and/or width of the walker.
Figure 8:
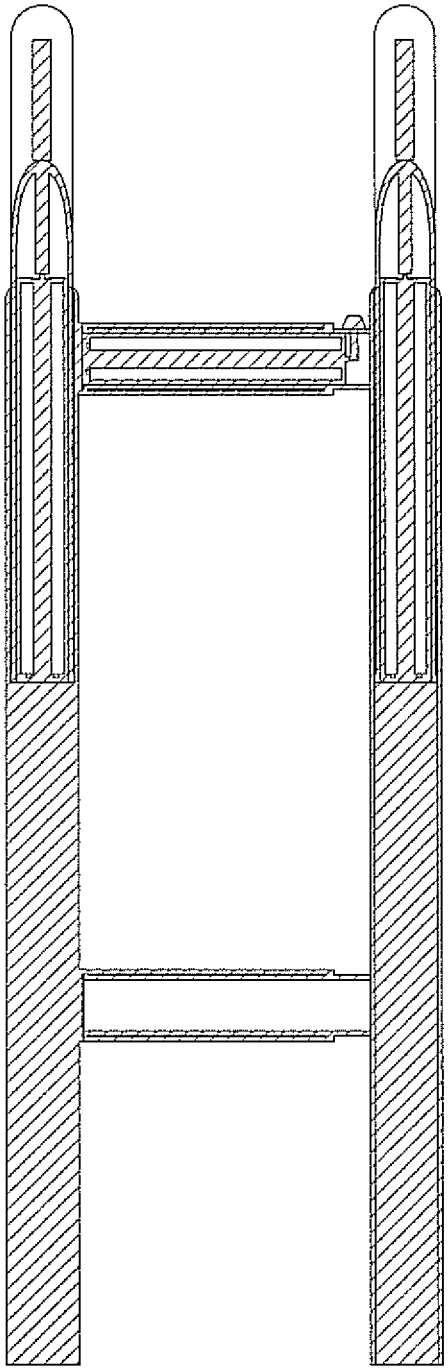
Figure 9:
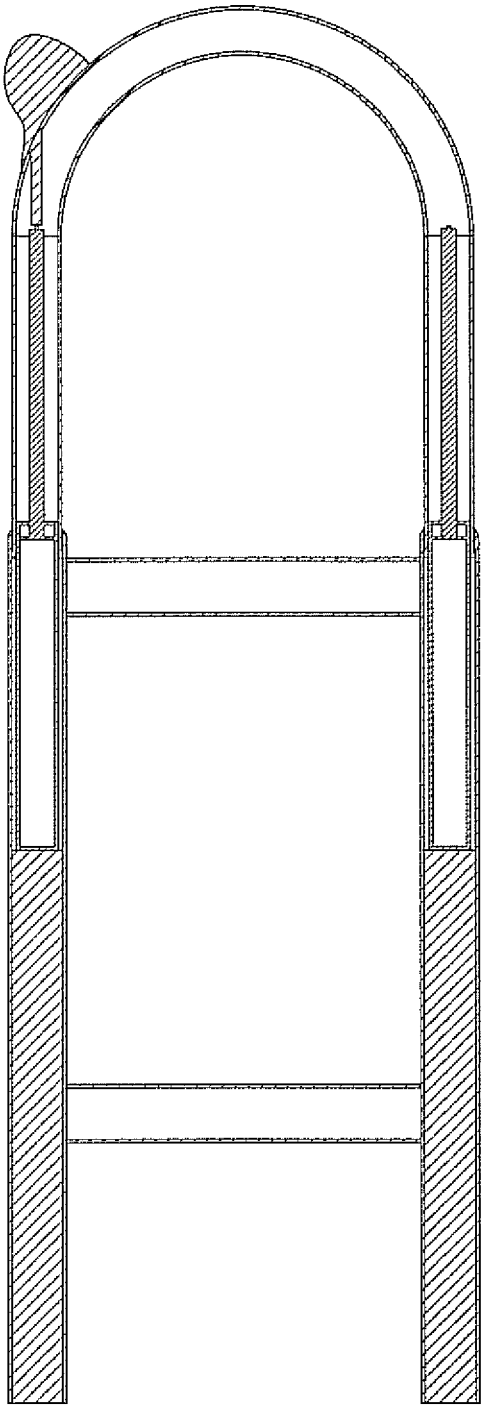
Figure 10:
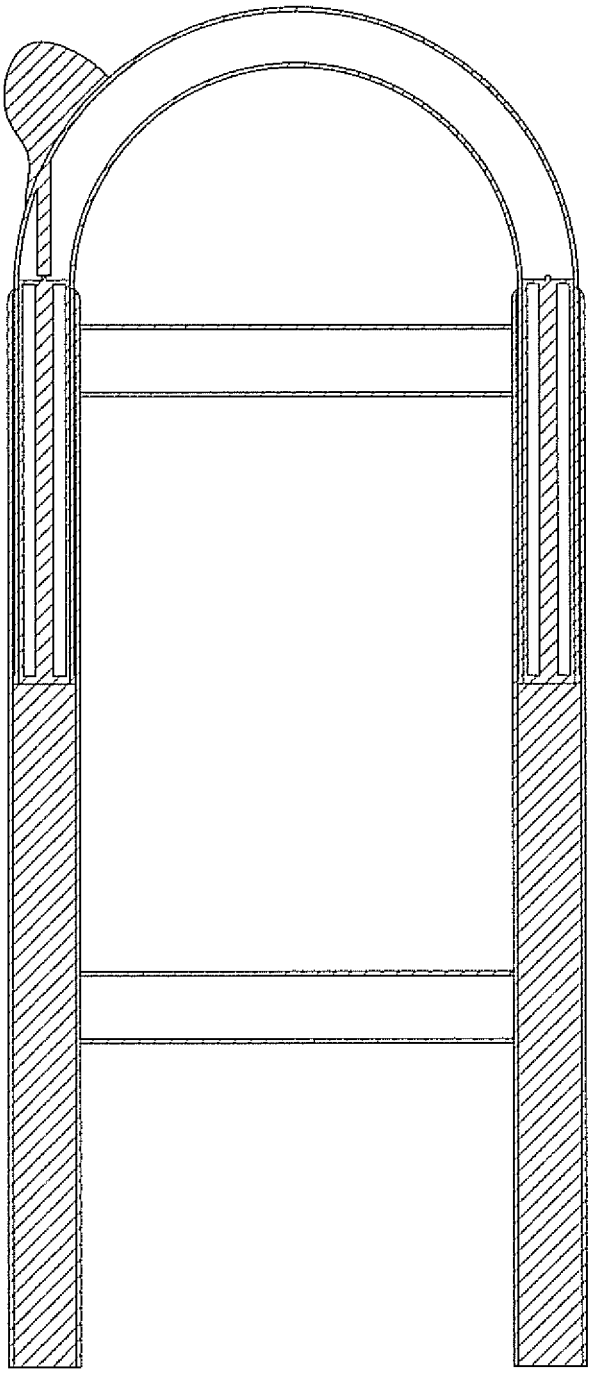
Figure 11:
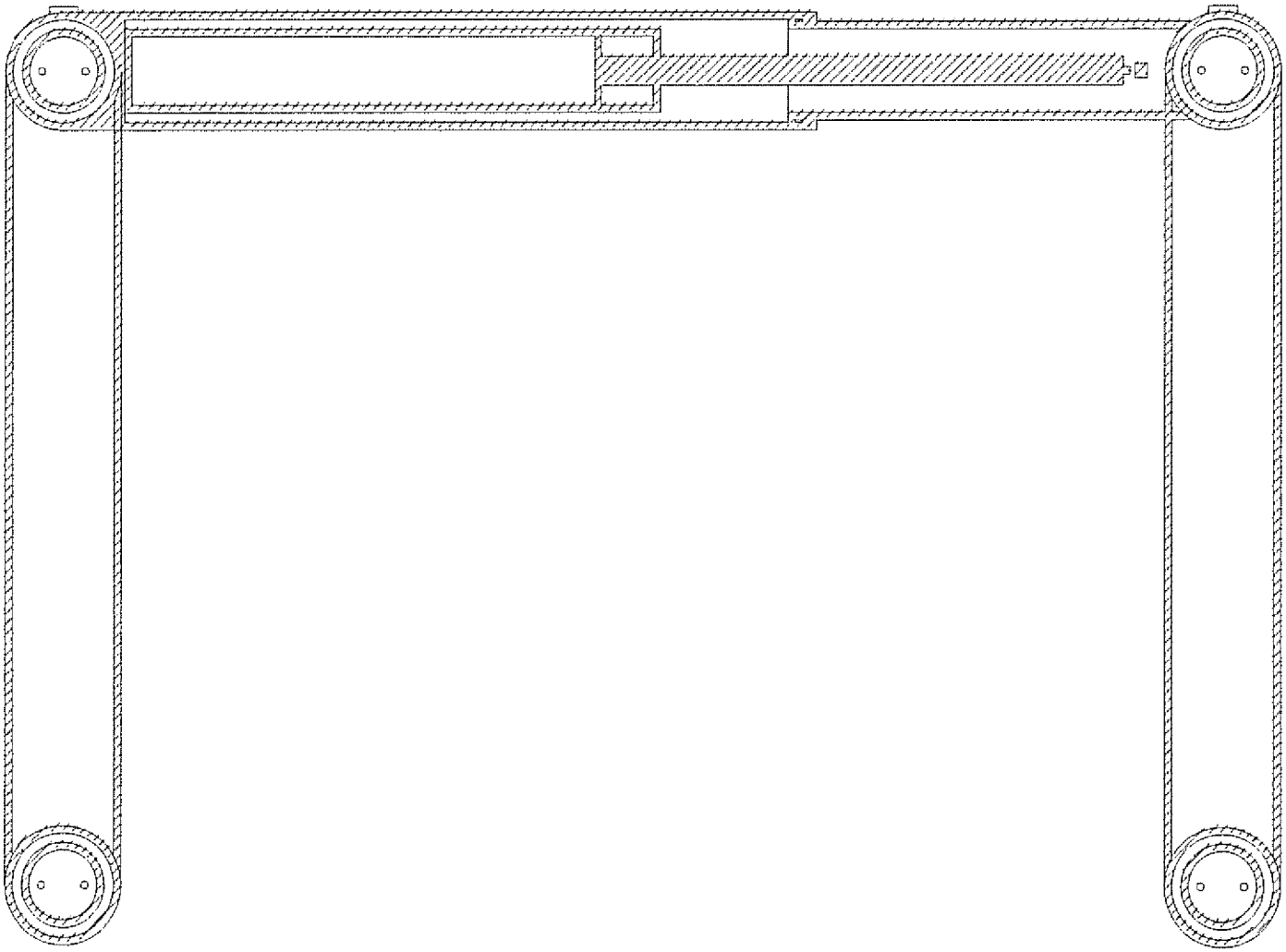
Figure 12:
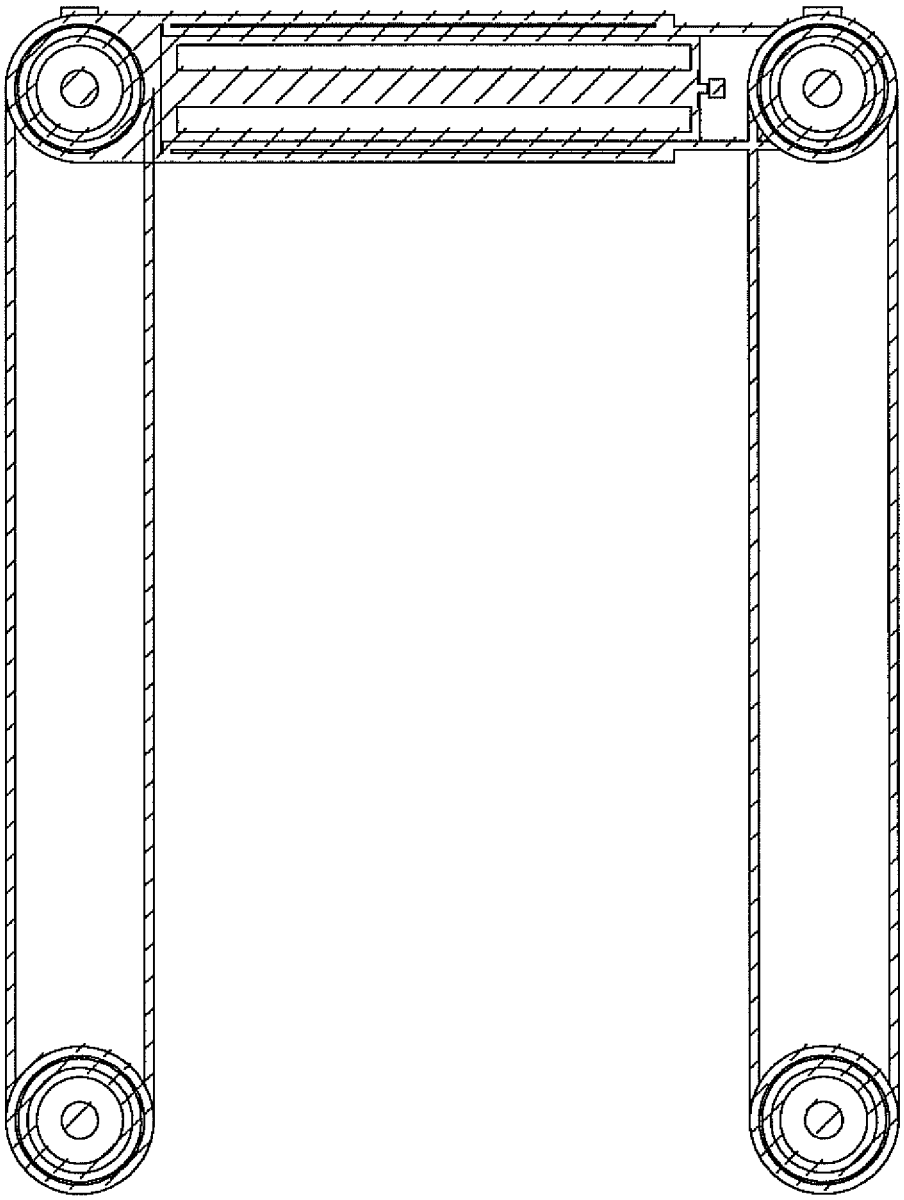
Figure 13:
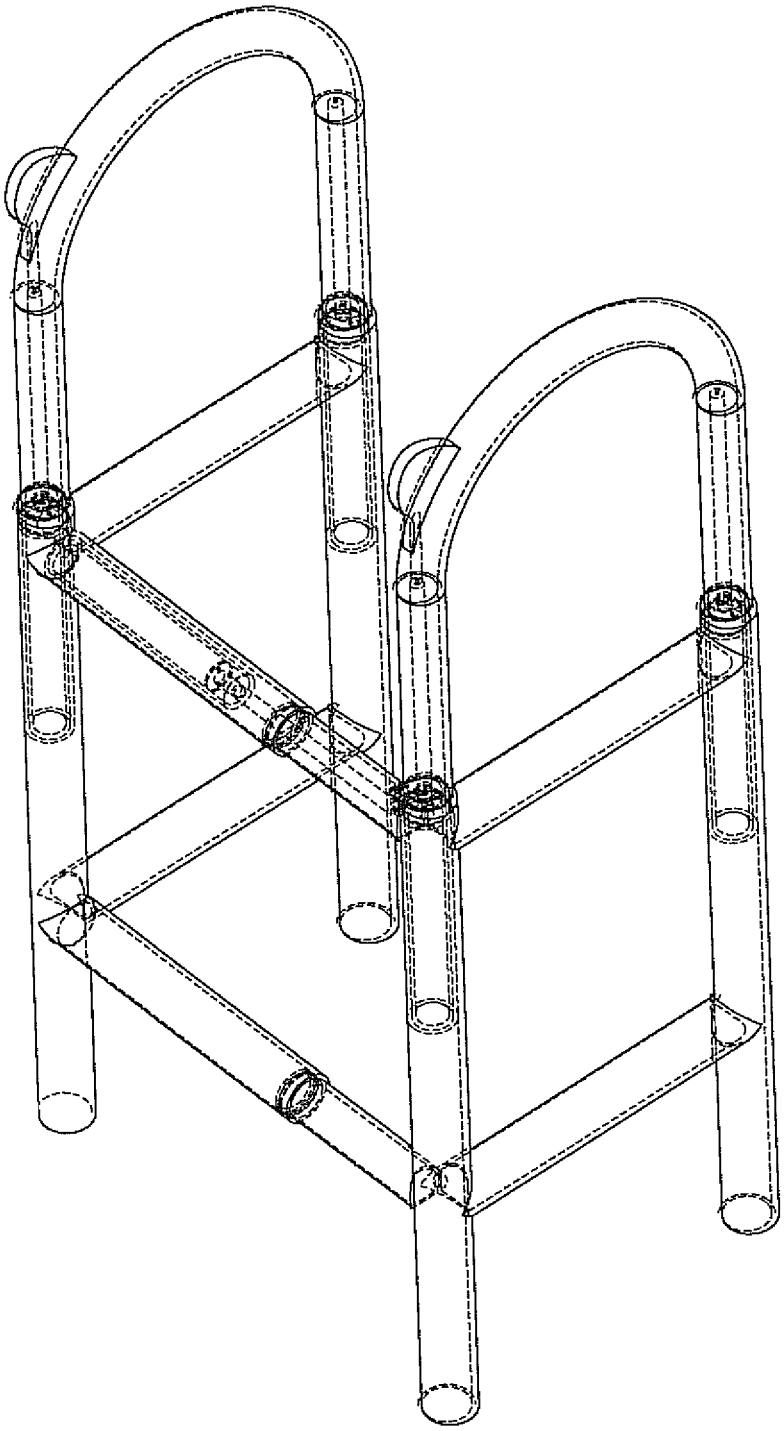
Figure 14:
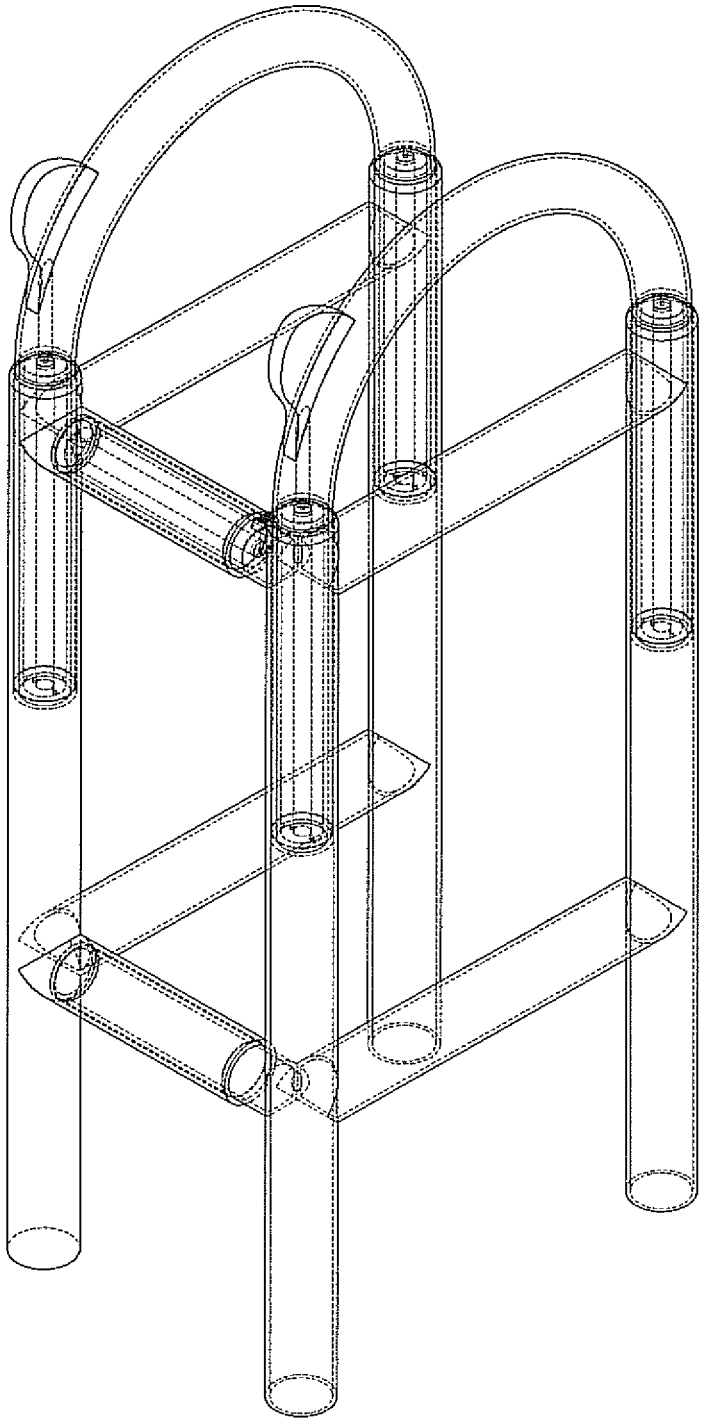

Each locking mechanism includes a plate 46 (FIGS. 5A, 5B, 6) that has a central opening through which the rods 38 can pass with small clearance. When the plate 46 is horizontal, as shown in FIG. 5B, the plate is tranverse or perpendicular to the axis of the rod 38 and the plate 46 and, therefore, the inner tube can move upwardly or downwardly relative to the rod. The plate 46 is affixed to the inner tube 14, preventing the plate 46 from moving relative to the rod when normally inclined as shown, it also fixes the inner tube relative to the outer tube 12. As is well known from caulking-gun type mechanism constructions, locking takes place when the plate is inclined relative to the rod and clearances therebetween are eliminated. This is normally achieved by pivoting the plates at pivots 48 on the inner tubes. A line 50 extends from the plate 46 to the actuators 34*a*, 34*b* to enable the plates 46 to be moved or pivoted to the normal, horizontal or perpendicular orientations against the action of a tension spring 52 which normally draws the plate to its incline or locking position. When inclined or in its normal relaxed condition, the plate 46, as indicated, seizes upon the rod 38 and prevents relative telescoping movements between the tubes 12, 14. When it is desired to raise or lower the handgrips 20, requiring relative movements of the telescoping tubes, the actuators 34*a*, 34*b* are moved by the user, such as by a pivoting action, to apply a tension to the line 50 thereby drawing the plates 46 to their horizontal orientations, as shown in FIG. 5B, enabling relative movement between the inner and outer tubes. This allows the handgrips to be either raised or lowered to accommodate the height of the user. Similarly, referring to FIG. 6, a rod 38' is stabilized at the end of the horizontal outer tube by means of a rod stabilizer (not shown) while the free end shown is slidably received within the inner tube for movements relative thereto. The plate 46' may be "righted" to move to a plane normal to the rod by pulling on the line 50' by hand of the user manipulating the actuator or trigger 36 which is secured to the plate 46' by means of a diverting sheave or pulley 54 as shown in FIG. 6. When the line 50' has a tension applied to it by the trigger or actuator 36 sufficient force must be applied to overcome the tension of the spring 52 which normally maintains the plate 46' in an inclined locking position. The line 50' may be wound on a spring-loaded spool 60 mounted for movement with the actuator 36 to maintain a tension on the line 50.

It will be appreciated that the described example of the adjustment and locking mechanisms for the height and width adjustments of the walker is only by way of example. Other mechanisms can be used to provide the same or similar functions, with different degrees of advantage.

In another embodiment of the present invention (FIGS. 7-14) the telescoping tubes are adjusted by the use of gas or pneumatic springs or hydraulic cylinders. There are two different types of gas springs used, a large gas spring and a small gas spring. The gas springs serve as the actuators in this embodiment. The large gas springs are vertically positioned inside each of the upper support legs, but the bottom of the large gas springs are rigidly attached to the tops of the solid regions of the lower support legs. The bases of the handles are attached to the tops of the upper support legs. This will allow for the handles and the upper support legs to move together. The small gas spring is horizontally positioned inside of the upper most inner support arm, but the bottom of the small gas spring is rigidly attached to the bottom of the outer support arm. The left end of the outer support arm is attached to one of the support legs and the right side of the inner support arm is attached to another support leg. This will allow the two sides of the walker to move toward and away from each other.

The adjustment mechanisms in this embodiment are a trigger system and a switch system. The trigger is attached to the exterior of the handles with the rest of the system remaining inside. The trigger system works similar to that of an office chair. When the trigger is squeezed the trigger system engages the large gas springs. While active the handles will either raise or lower depending on how much force is being applied. When the trigger is released the gas spring becomes inactive and the vertical movement of the handles becomes locked. The switch system works in a very similar fashion. The switch is located on the exterior of the inner support arm and the rest of the system is located inside of the inner support arm. When the switch is pressed, the switch system engages the small gas spring. While the small gas spring is active the left and right and right sides of the invention are free to move towards or apart from each other, depending on the magnitude and direction of force applied. When the switch is moved back and the switch system disengages the small gas spring, the horizontal movement of the gas spring becomes locked.

Although the invention has been explained in relation to its preferred embodiment, it is to be understood that many other possible modifications and variations can be made without departing from the spirit and scope of the invention as hereinafter claimed.

The invention claimed is:

1. An adjustable walker comprising a tubular frame construction having substantially vertical front and rear lateral telescoping tubes arranged in left and right pairs and substantially horizontal telescoping tubes extending between said vertical front lateral telescoping tubes to define a walker space for a user therebetween, said vertical front lateral telescoping tubes defining a common plane, handgrips extending between upper ends of each pair of front and rear lateral telescoping tubes for being grasped by a user, said horizontal telescoping tubes being adjustable in length to adjust the width of the walker space for the user and said vertical lateral telescoping tubes being adjustable in length to adjust the heights of the handgrips, said vertical lateral telescoping tubes being arranged to vertically expand and contract so that said handgrips can be raised and lowered; first locking means for locking said vertical front lateral telescoping tube associated with each handgrip; second locking means for locking at least one of said horizontal telescoping tubes; a first actuator on said handgrips for selectively unlocking said first locking means during use to allow a user to adjust the height of said handgrips; a second actuator on said handgrips for selectively unlocking said second locking means during use to allow a user to adjust the width of said walker space, whereby the height of said handgrips and/or width of the walker can be selectively adjusted by a user with said first and second actuators while holding said handgrips during use of the walker.

2. An adjustable walker as defined in claim 1, wherein said first and second locking means comprise caulking gun mechanisms.

3. An adjustable walker as defined in claim 1, wherein said first and second locking means comprise pneumatic cylinders.

4. An adjustable walker as defined in claim 1, said first and second locking means comprise hydraulic cylinders.

5. An adjustable walker as defined in claim 1, wherein said first locking means is arranged in each of said vertical telescoping tubes for independent actuation of height of said handgrips.

6. An adjustable walker as defined in claim 1, wherein said second actuator is mounted on one of said handgrips for actuation by the user.

7. An adjustable walker as defined in claim 1, wherein said first actuator is mounted on each handgrip for actuation by a user's fingers.

8. An adjustable walker as defined in claim 1, wherein at least one of said locking means comprises a central rod extending through a pair of telescoping tubes; stabilizing means for securing said central rod centered or coaxially within said tubes having a central opening for receiving said rod with a movable plate clearance and pivotably mounted on an outer tube and movable between an orientation normal to said rod to allow movement of said plate and outer tube relative to said rod and inner tube and inclined relative to said rod to eliminate said clearance to cause the plate and outer tube to engage and lock against relative movements of said tubes; biasing means for normally maintaining said plate in an inclined locking orientation; and means for coupling said plate to an actuator to selectively move said plate to an unlocked condition against the action of said biasing means.

9. An adjustable walker as defined in claim 8, wherein said biasing means comprises a tension spring.

10. An adjustable walker as defined in claim 8, wherein said coupling means comprises a line extending between an associated actuator and a plate.

11. An adjustable walker as defined in claim 10, wherein said second locking means is located in at least one of said vertical front lateral telescoping tubes and the direction of said line is re-directed by means of a sheave proximate to the position where said vertical front lateral telescoping tubes meet said horizontal telescoping tubes.

12. An adjustable walker as defined in claim 11, wherein said line is wound on a spring loaded spool in proximity to said second actuator for maintaining tension in said line and means for moving said spool along said line while preventing rotation of said spool to thereby apply a force on said plate to move same to a releasing position independently of the positions of said handgrips and the distance between said lateral telescoping tubes.

13. An adjustable walker comprising a tubular frame construction having substantially vertical front and rear lateral telescoping tubes arranged in left and right pairs and substantially horizontal telescoping tubes extending between said vertical front lateral telescoping tubes to define a walker space for a user therebetween, said vertical front lateral telescoping tubes defining a common plane, handgrips extending between upper ends of each pair of front and rear lateral telescoping tubes for being grasped by a user, said horizontal telescoping tubes being adjustable in length to adjust the width of the walker space for the user and said vertical lateral telescoping tubes being adjustable in length to adjust the heights of the handgrips, said vertical lateral telescoping tubes being arranged to vertically expand and contract so that said handgrips can be raised and lowered; first locking means for locking said vertical front lateral telescoping tube associated with each handgrip; second locking means for locking at least one of said horizontal telescoping tubes; a first actuator on said handgrips for selectively unlocking said first locking means during use to allow a user to adjust the height of said handgrips; a second actuator on said handgrips for selectively unlocking said second locking means during use to allow a user to adjust the width of said walker space, whereby the height of said handgrips and/or width of the walker can be selectively adjusted by a user with said first and second actuators while holding said handgrips during use of the walker, said first actuator being provided on each of said handgrips and said second actuator being provided on one of said handgrips, whereby adjustments of the width of said walker space and the height of said handgrips can be made independently and contemproneously or in succession while holding said handgrips without removal of the hands of the person making the adjustments from said handgrips.

14. An adjustable walker comprising a tubular frame construction having substantially vertical front and rear lateral telescoping tubes arranged in left and right pairs and substantially horizontal telescoping tubes extending between said vertical front lateral telescoping tubes to define a walker space for a user therebetween, said vertical front lateral telescoping tubes defining a common plane, handgrips extending between upper ends of each pair of front and rear lateral telescoping tubes for being grasped by a user, said horizontal telescoping tubes being adjustable in length to adjust the width of the walker space for the user and said vertical lateral telescoping tubes being adjustable in length to adjust the heights of the handgrips, said vertical lateral telescoping tubes being arranged to vertically expand and contract so that said handgrips can be raised and lowered; first locking means for locking said vertical front lateral telescoping tube associated with each handgrip; second locking means for locking at least one of said horizontal telescoping tubes; a first actuator on said handgrips for selectively unlocking said first locking means during use to allow a user to adjust the height of said handgrips; a second actuator on said handgrips for selectively unlocking said second locking means during use to allow a user to adjust the width of said walker space, whereby the height of said handgrips and/or width of the walker can be selectively adjusted by a user with said first and second actuators while holding said handgrips during use of the walker, said first and second actuators being arranged on said handgrips in proximity to said common plane, whereby a caregiver or attendant facing said walker space on the other side of front telescoping tubes can have easy access to said actuators while a patient in said walker space can continue to grip said handgrips over substantially the entire lengths thereof between said front and rear lateral telescoping tubes.

* * * * *